US005659282A

United States Patent [19]

Nemoto

[11] Patent Number: 5,659,282

[45] Date of Patent: Aug. 19, 1997

[54] CYLINDRICAL FUSE HOLDER WITH A SOCKET MOVABLE AXIALLY IN THE HOLDER

[75] Inventor: Kazuhiro Nemoto, Kawasaki, Japan

[73] Assignee: SMK Co., Ltd., Tokyo, Japan

[21] Appl. No.: 429,796

[22] Filed: Apr. 27, 1995

[30] Foreign Application Priority Data

Aug. 30, 1994 [JP] Japan ..... 6-228667

[51] Int. Cl.[6] ..... H01H 85/02

[52] U.S. Cl. ..... 337/201; 337/227; 337/195

[58] Field of Search ..... 337/190–194, 337/195, 206, 208, 213, 201, 227, 228, 239, 244–248

[56] References Cited

U.S. PATENT DOCUMENTS 3,132,224 5/1964 Bulgin ..... 337/195

3,286,061 11/1966 Henderson ..... 337/195

4,504,815 3/1985 Harwath ..... 337/201

*Primary Examiner*—Leo P. Picard

*Assistant Examiner*—Jayprakash N. Gandhi

*Attorney, Agent, or Firm*—Armstrong, Westerman, Hattori, McLeland & Naughton

[57] ABSTRACT

A cylindrical fuse holder assembled by uniting a molded holder body and a molded cap between which a fuse tube is steadily held by means of a socket movable axially in the holder, a coil spring for pressing the socket so as to bring the socket in contact with a side contact piece in the holder body, and another coil spring for pressing the fuse tube. The socket pressing spring for urging the socket is integrally connected to the fuse tube pressing spring. Thus, this fuse holder can be composed of a small number of parts, assure high stability of electrical connection, and be used in safety.

3 Claims, 4 Drawing Sheets

CYLINDRICAL FUSE HOLDER WITH A SOCKET MOVABLE AXIALLY IN THE HOLDER

BACKGROUND OF THE INVENTION

1. Field of the Invention

This invention relates to a cylindrical fuse holder for accommodating a fuse tube for use in an electric power source unit of electronic equipment.

2. Description of the Prior Art

There has been generally known a prior art cylindrical fuse holder formed in a cylindrical shape on the whole by uniting a holder body and a cap between which a fuse tube is held, as shown in FIG. 9. To be more specific, this conventional cylindrical fuse holder comprises the holder body 1 formed in a cylinder with a bottom by molding, and the cap 2 formed by molding for closing the opening of the holder body 1. Within the holder body 1, there are mounted a bottom contact piece 3 on the bottom of the holder body 1, and a side contact piece 4 attached on the inner circumferential surface of the holder body. Within the cap 2, a conductive metal cylinder 5 is integrally formed by insert-molding and has its leading end extending inside the holder body 1. In the metal cylinder 5, there are mounted a socket 7 having a pair of pinch pieces 7*a* and 7*b* between which one of the terminal portions of the fuse tube 6 is held, and a fuse tube pressing spring 8 formed of a coil spring and inextricably disposed for exerting the fuse tube 6 outward. The outer peripheral surface of the outwardly protruded part of the metal cylinder 5 placed in the cap 2 has a male screw, and correspondingly, the inner peripheral surface of the annular part 4*a* of the side contact piece 4 has a female screw. By engaging both the screws, the holder body 1 is closed with the cap 2.

To retain the fuse tube 6 within the cylindrical fuse holder, upon removal of the cap 2 from the holder body, one of the terminal portions of the fuse tube 6 is first inserted into the metal cylinder 5 to hold the fuse tube 6 between the pinch pieces 7*a* and 7*b* of the socket 7, and then, the leading end of the metal cylinder 5 is thrust into the annular part 4*a* of the side contact piece 4. Thus, the fuse tube 6 is retained in position within the cylindrical fuse holder in such a state the other terminal portion of the fuse tube 6 is brought into press contact with the bottom contact piece 3 by the spring 8, establishing an electrical connection between the other terminal portion of the fuse tube 6 and the contact piece 4 through the spring 8 and the metal cylinder 5.

The conventional cylindrical fuse holder as described above can assure high stability because the holder body and the cap are steadily screwed. However, since both the principal components with having the screws are formed of metal, they must be made by cutting, resulting in increasing the cost of production and the number of component parts. As a result, the conventional fuse holder thus produced has a disadvantage of being rather expensive.

Furthermore, the conventional fuse holder is disadvantageous in that, in the work of screwing the cap into the holder body, the side surface of the metal cylinder protruding from the cap is exposed between the cap and the holder body, thus involving a danger of receiving an electric shock if an electric current flows the fuse.

OBJECT OF THE INVENTION

This invention is made to eliminate the drawbacks suffered by the conventional fuse holder as described above and has an object to provide a cylindrical fuse holder capable of enhancing stability in use and being used in safety without exposing the electrically active parts thereof.

SUMMARY OF THE INVENTION

To attain the object described above according to the present invention, there is provided a cylindrical fuse holder comprising an insulating holder body formed in a cylinder with a bottom to accommodate a fuse tube having terminal portions, and a cap formed in a cylinder with a bottom, which cap is fitted to the opening of the aforesaid holder body while receiving one part of the aforesaid fuse tube, which holder body includes a bottom contact piece disposed on the bottom in the holder body, with which one of the terminals of the aforesaid fuse tube accommodated in the holder body comes into contact, which cap is provided in its inner top portion with a fuse tube pressing spring for urging the fuse tube and a conductive socket for holding one of the terminal portions of the fuse tube, which holder body is provided with a side contact piece being in electric contact with one part of the aforesaid socket in the state of uniting the aforesaid cap to the holder body, wherein the aforesaid socket is movable in the axial direction of the cap and urged outward by a socket pressing spring, and the leading end of the socket is brought into contact with the side contact piece in the holder body.

The leading end of the aforesaid socket is formed in the shape of a circle, and the side contact piece is preferably provided with a ring-shaped socket contact piece being in contact with the inner surface of the holder body so as to bring the leading end of the socket into press contact with the socket contact piece.

The fuse tube pressing spring and the socket pressing spring may be formed separately or integrally made of one wire material. In any case, these springs may be formed of coaxially arranged coils having different diameters.

The cylindrical fuse holder of this invention can steadily retain the fuse tube inside the holder body with a simple operation by merely inserting the fuse tube into the cap disconnected from the holder body and uniting the cap to the holder body. The fuse tube thus retained is resiliently held between the fuse tube pressing spring and the bottom contact piece in the fuse holder. In the meantime, the socket is urged outward by the socket pressing spring, thus bringing the leading end of the socket into resilient contact with the side contact piece in the holder body.

Since the leading end of the socket is shaped in a circle and the side contact piece of the holder body is provided with the ring-shaped socket contact piece, the contacting area between the socket and the socket contact piece is increased, thus assuring high stability of electrical contact.

Since the fuse tube pressing spring and the socket pressing spring can be formed in one coil spring, the fuse holder can be assembled with ease.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

One preferred embodiment of the cylindrical fuse holder according to this invention will be described hereinafter with reference to FIG. 1 through FIG. 5.

Figure 1:
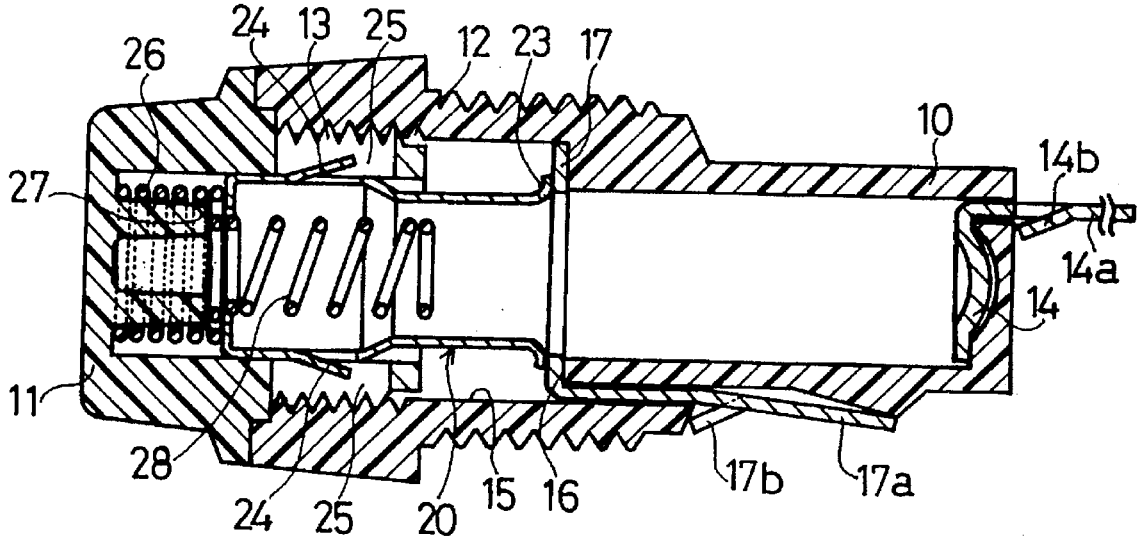
FIG. 1 is a sectional view showing one embodiment of a cylindrical fuse holder according to this invention.
Figure 2:
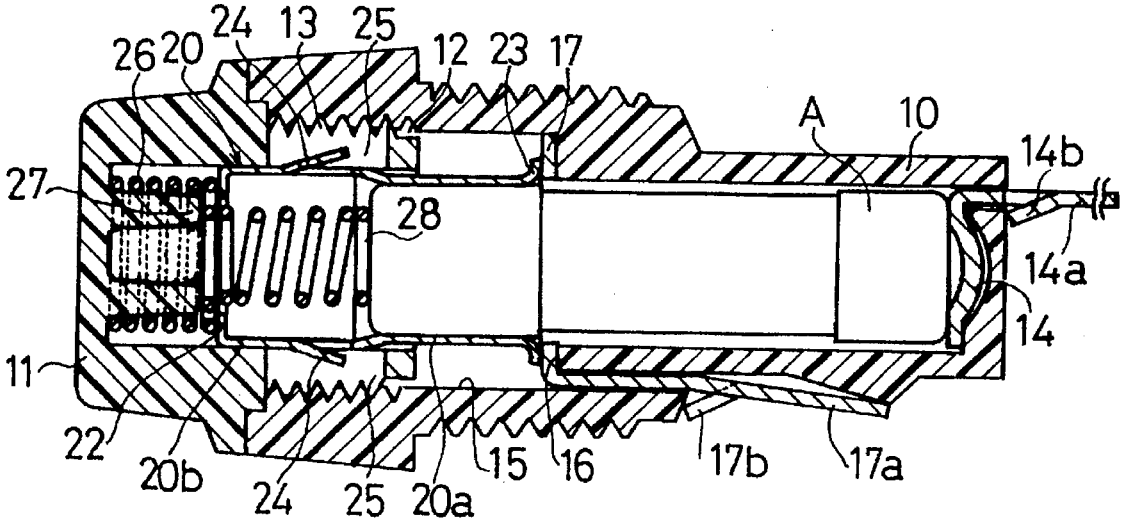
FIG. 2 is a sectional view showing the state of fitting a fuse tube to the fuse holder of this invention.

In FIGS. 1 and 2, the whole structure of the cylindrical fuse holder in this embodiment is shown. FIG. 1 illustrates the state before a fuse tube is placed in a holder body 10, and FIG. 2 shows the state of placing the fuse tube A in the holder body 10. Denoted by 11 is a cap. These elements are made of synthetic resins by molding. The holder body 10 is formed in a cylinder having a bottom, a holder opening and a female screw 12 formed in the inner surface along the holder opening. Similarly, the cap 11 is formed in a cylinder having a bottom, a cap opening and a male screw 13 formed in the outer surface along the cap opening so as to be engaged with the female screw 12 of the holder body.

Within the holder body 10, a bottom contact piece 14 is placed on the bottom thereof. The contact piece 14 has a terminal 14*a* pierced through the bottom of the holder body. The contact piece 14 has a raise claw 14*b* for inextricably retaining the terminal 14*a*. The holder body 10 has an expanded portion 15 confronting the opening. The female screw 12 is formed in the inner surface of the expanded portion 15. Between the expanded portion 15 and the other part of the holder body 10, there is formed an annular stage 16 on which a ring-shaped side contact piece 17 is seated. The side contact piece 17 has a terminal 17*a* extending outside through a hole bored in the holder body and is inextricably retained by a raise claw 17*b*.

Figure 3:
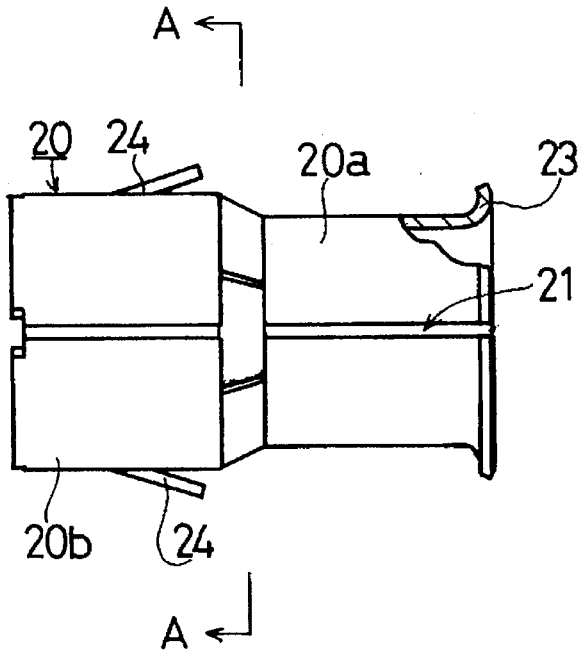
FIG. 3 is a partially cutaway side view showing a socket for use in the fuse holder of this invention.
Figure 4:
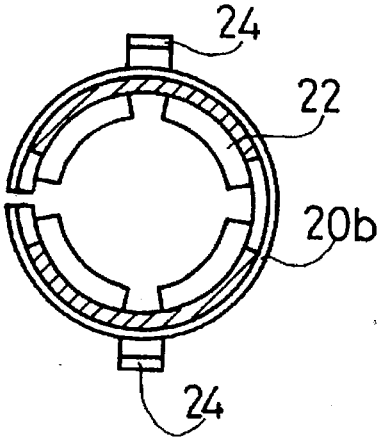
FIG. 4 is a sectional view taken on the line A—A in FIG. 3.

Within the cap 11, there is placed a socket 20 formed in a cylinder of a conductive metal plate by pressing. As illustrated in FIG. 3 and FIG. 4, the socket 20 has slits 21 longitudinally extending to openings in both ends thereof so as to be elastically deformed in the radial direction. The socket 20 has a narrow portion 20*a* protruding out of the cap 11 and a major diameter portion 20*b* placed in the cap, and a flange 22 extending inwardly from one end of the socket. The narrow portion 20*a* has a diameter reduced to the extent of tolerantly holding the fuse tube A. The narrow portion 20*a* is provided on its free end with a curved flange 23 spread outward.

Figure 5:
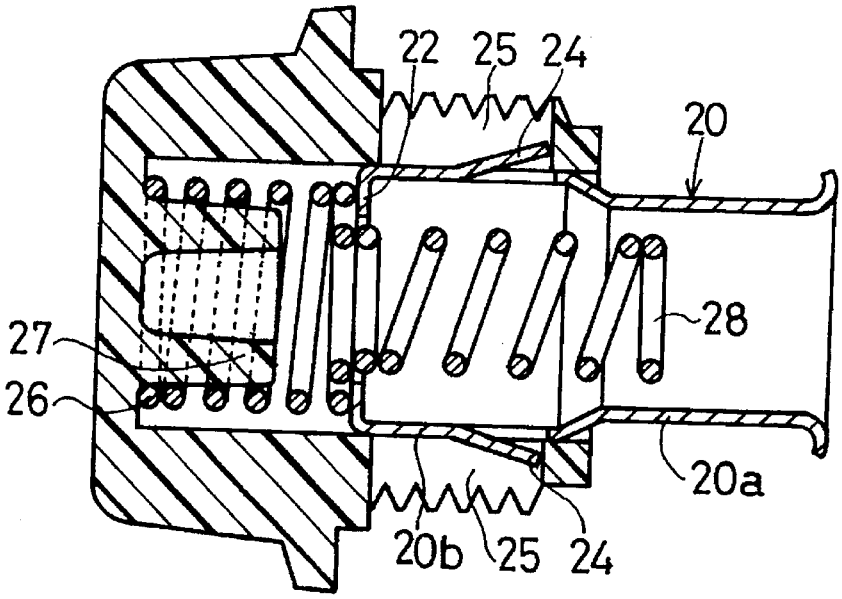
FIG. 5 is a sectional view showing a cap separated from a holder body of the fuse holder of this invention.
Figure 6:
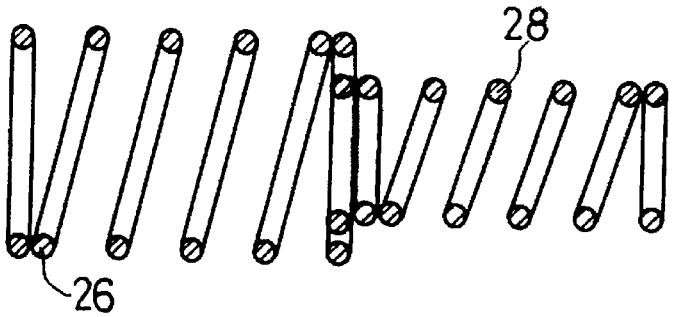
FIG. 6 is a side view showing a spring incorporated in the fuse holder of this invention.
Figure 7:
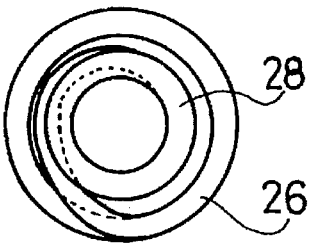
FIG. 7 is a front view of FIG. 6.

The major diameter portion 20*b* has a pair of raise claws 24 opposed to each other, which are fitted into longitudinal slots 25 formed in the cap 11 so as to prevent the socket 20 from being removed in site from the cap, as shown in FIGS. 1, 2 and 5. Each slot 25 is made longer than the raise claw 24 so as to permit the socket 20 to move in the longitudinal direction in the cap 11. When the cap 11 is united with the holder body 10, the outwardly curved flange 23 is brought into contact with the side contact piece 17 as shown in FIGS. 1 and 2.

Between the inwardly extending flange 22 of the socket 20 and the innermost part of the cap 11, there is defined a space in which the socket pressing spring 26 composed of a coil spring is placed in its compressed state, thus urging the socket 20 outwardly. The socket pressing spring 26 is retained in position coaxial with the cap 11 by a projection 27 on the inner surface of the top of the cap 11.

The socket pressing spring 26 has the leading end connected integrally to a fuse tube pressing spring 28 having a small diameter. This fuse tube pressing spring 28 extends inside the narrow portion 20*a* of the socket 20 through the flange 22. As the cap 11 is threaded on the holder body 10 accommodating the fuse tube A, the fuse tube is steadily held between the compressed fuse tube pressing spring 28 and the side contact piece 14.

The cylindrical fuse holder thus assembled serves to retain the fuse tube A within the united cap 11 and holder body 10 in the appropriate state of being urged by the spring 28 against the contact piece 14.

The socket 20 is urged by the spring 26 to bring the flange 23 formed at the leading of the socket 20 in press contact with the contact piece 17. Thus, the other terminal of the fuse tube A comes into electrical contact with the contact piece 17 through the springs 26 and 28 and the socket 20. Since the fuse tube A is held by the narrow portion 20*a* of the socket 20, the electrical connection between the other terminal of the fuse tube A and the contact piece 17 can be established without the springs 26 and 28.

Figure 8:
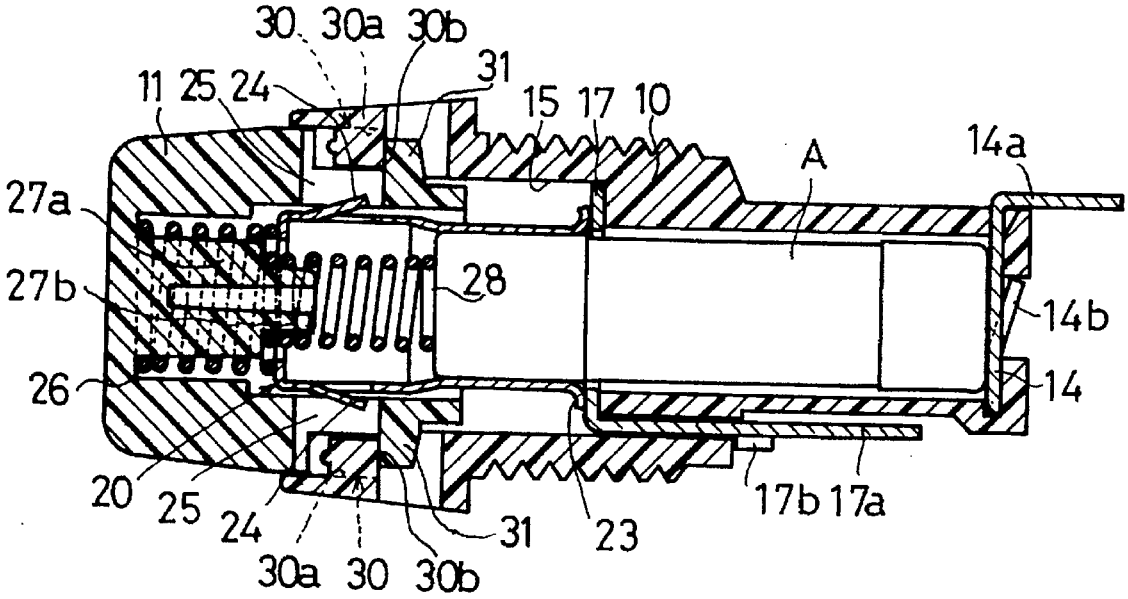
FIG. 8 is a sectional view showing another embodiment of the cylindrical fuse holder of this invention.
Figure 9:
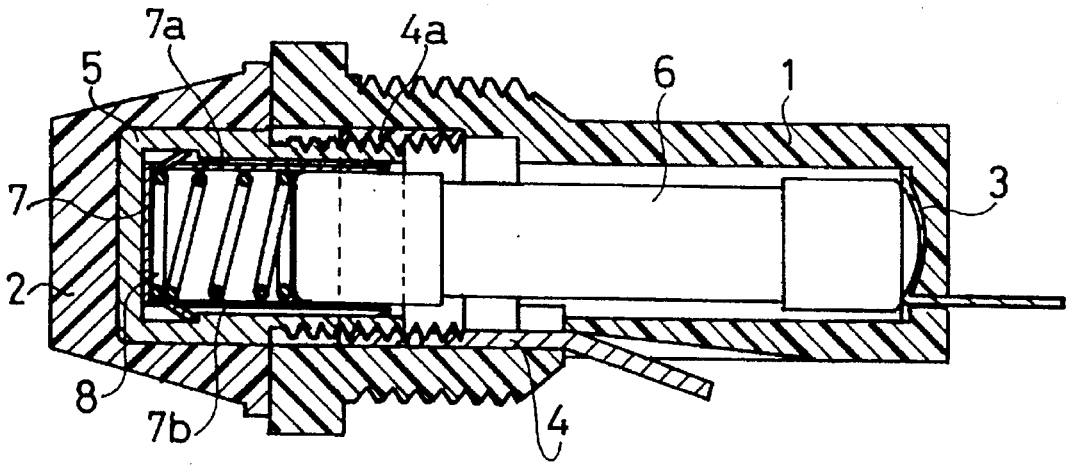
FIG. 9 PRIOR ART
FIG. 9 is a sectional view of a conventional fuse holder.

Although the fuse holder in the aforenoted embodiment adopts the construction in which the cap 11 is threaded on the holder body 10, it may employ the so-called bayonet structure as illustrated in FIG. 8. To be specific, the holder body 10 has L-shaped grooves 30 in the peripheral portion of the opening thereof, and correspondingly, the cap 11 is provided with longitudinal grooves 30*a* with projections 31 to be fitted into the L-shaped grooves 30 in the holder body 10. In the case of uniting the cap 11 with the holder body 10, the holder body 10 is screwed into the cap 11 with fitting the projections 31 into the L-shaped grooves 30*b*, and then, the cap 11 is rotated while moving the projections 31 along the L-shaped grooves 30*b*. As a result, the cap 11 is inextricably united with the holder body 10.

In this embodiment of FIG. 8, the projection 27 is composed of a large diameter portion 27*a* for supporting the socket pressing spring 26 and a small diameter portion 27*b* for supporting the fuse tube pressing spring 28. In such a manner, the pressing springs 26 and 28 may be supported by any other measures. In the embodiment shown in FIG. 8, the element depicted by the like reference numerals with respect to those of the first embodiment described above have analogous structures and functions to those of the first embodiment and will not be described in detail again.

As is understood from the foregoing description, according to the present invention, since the cylindrical fuse holder adopts the structure in which the insulating holder body and cap are screwed to define the fuse accommodating space for permitting the socket to move while being urged by the socket pressing spring, the fuse tube is steadily held in press connection with the side contact piece within the holder, thus securing the stability of electrical connection between the fuse tube and the contact pieces. Furthermore, even when the cap and the holder body are engaged while passing an electric current therethrough, there is no danger of receiving an electric shock because the contact pieces are not exposed.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A cylindrical fuse holder comprising a holder body formed in a cylinder with a bottom and an opening for accommodating a fuse tube having terminal portions, and a cap formed in a cylinder with a bottom, said cap being fitted on said holder body to close the opening of said holder body while receiving one part of said terminal portions of said fuse tube, said holder body including a bottom contact piece disposed on said bottom in said holder body, with which the other terminal portions of said fuse tube placed in said holder body comes into contact, said cap being provided in its inner top portion with a fuse tube pressing spring for urging said fuse tube and a conductive socket for holding said one terminal portion of said fuse tube, said holder body being provided with a side contact piece in electric contact with one part of said socket within the united cap and holder body, wherein said socket is movable axially in said cap and urged outward by a socket pressing spring, and wherein said socket pressing spring further urges the leading end of said socket so as to be brought into contact with said side contact piece in the holder body.

2. A cylindrical fuse holder according to claim 1, wherein said leading end of said socket is formed in the shape of a circle, and said side contact piece in said holder body is provided with a ring-shaped socket contact piece in contact with the inner surface of said holder body to bring the leading end of said socket into press contact with said socket contact piece.

3. A cylindrical fuse holder according to claim 1, wherein said fuse tube pressing spring and said socket pressing spring is integrally made of one coil wire.

* * * * *